United States Patent [19]

Winter

[11] Patent Number: 4,712,760

[45] Date of Patent: Dec. 15, 1987

[54] BOOK REST WITH PAGE RETAINER

[76] Inventor: Howard J. Winter, 4131 E. Indian School Rd. #209, Phoenix, Ariz. 85018

[21] Appl. No.: 918,707

[22] Filed: Oct. 14, 1986

[51] Int. Cl.[4] ..... A47B 97/04

[52] U.S. Cl. ..... 248/451; 248/473

[58] Field of Search ..... 248/451, 452, 453, 460, 248/459, 473; 312/233; 281/45, 33; 294/137

[56] References Cited

U.S. PATENT DOCUMENTS

| | | | |
|---|---|---|---|
| 264,623 | 9/1882 | Bynon | 248/451 |
| 1,915,762 | 6/1933 | Rost | 248/473 X |
| 2,441,932 | 5/1948 | Curry | 248/460 X |
| 2,767,497 | 10/1956 | Munson | 248/473 X |
| 3,227,415 | 1/1966 | Fisher | 281/45 X |
| 4,065,091 | 12/1977 | Ulrich | 248/473 |

*Primary Examiner*—J. Franklin Foss

*Attorney, Agent, or Firm*—Herbert E. Haynes, Jr.

[57] ABSTRACT

A book rest for supporting books or magazines in an opened position to facilitate the use thereof by persons seated at a desk, library table or the like. The book rest includes a base from which a prop structure extends in a leaning back attitude and the prop structure is configured to define an included angle which opens toward the front of the base. The base and prop structure cooperate to support the book or magazine in a propped up position against the front surface of the prop structure and a pair of hook-like devices are associated with the prop structure to releasably hold the pages in a desired opened position.

13 Claims, 5 Drawing Figures

BOOK REST WITH PAGE RETAINER

BACKGROUND OF THE INVENTION

1. Field of the Invention

This invention relates in general to structures for supporting books and magazines and more particularly to a book rest for supporting books and magazines in a leaning propped-up attitude and having means for releasibly retaining the pages thereof in an opened position.

2. Description of the Prior Art

As is well known, there is often a need for supporting a book, magazine or the like in a propped up position so that it can be conveniently read when the person using the book is seated at a desk, library table and the like. When such supporting is needed or desired, the user will normally use one or both hands to accomplish the task and this prevents, or at least makes it difficult for the user to use his or her hands for other purposes. For example, it is difficult for a student, law clerk or anyone else to take notes or otherwise write when using a book for research, reference work or the like.

Some people attempt to ease this problem by leaning the book in a propped up position on any convenient object such as a stack of books placed on the desk or table for that purpose. In the case of magazines, this usually doesn't work very well due to the lack of rigidity of most magazines. Books, of course are more rigid and thus better able to be propped up. However, both books and magazines have a tendency to slide on the surface of the desk or table. Even under the best conditions, propping up books and magazines by leaning them against convenient objects does not provide a complete answer in that the pages have a tendency to close or flip over and thus must be held in the desired open position.

To the best of my knowledge, no book rest structure has been devised or suggested which solves the above described problems.

SUMMARY OF THE INVENTION

In accordance with the present invention, a new and useful book rest is disclosed for supporting books and magazines in a leaning propped-up attitude to facilitate the use thereof while a person is seated at a desk, library table and the like. The book rest includes an elongated base for resting on the surface of a desk or table with a prop structure extending from the base. The base and prop structure are configured so that the prop structure is disposed in a leaning attitude, e.g. is angularly displaced from the vertical, and is preferably normal with respect to the upper planar surface of the base. The prop structure is formed with an integral pair of juxtaposed planar prop segments or surfaces which define an included angle of less than 180°.

The leaning attitude of the prop structure, the right angle relationship of the prop structure with respect to the upper surface of the base and the included angle defined by the prop segments cooperatively allows a book to be propped up in an ideally supported position with the book leaning against the prop structure and with the lower edges of the book being in resting engagement with the base.

The book rest of the present invention also includes means mounted on the prop structure for releasibly retaining the pages of a book in a desired opened position. The page retaining means is in the form of a pair of hook-like devices each demountably carried in a different one of a pair of slots provided in the planar segments of the prop structure and each being adjustably movable in its respective slot to allow positioning thereof to suit books of different sizes. Each of the hook-like devices is positionable so as to pass around the one of the side edges of the book's cover and bear lightly on the page or pages which are adjacent the cover.

Accordingly, it is an object of the present invention to provide a new and useful book rest structure for supporting books and magazines in a leaning propped-up position.

Another object of the present invention is to provide a new and useful book rest structure for supporting books and magazines in a leaning propped-up position and including means for releasably holding the pages of the book or magazine in a desired open position.

The foregoing and other objects of the present invention may be more fully understood from the following description when read in conjunction with the accompanying drawings.

DESCRIPTION OF THE PREFERRED EMBODIMENTS

Figure 1:
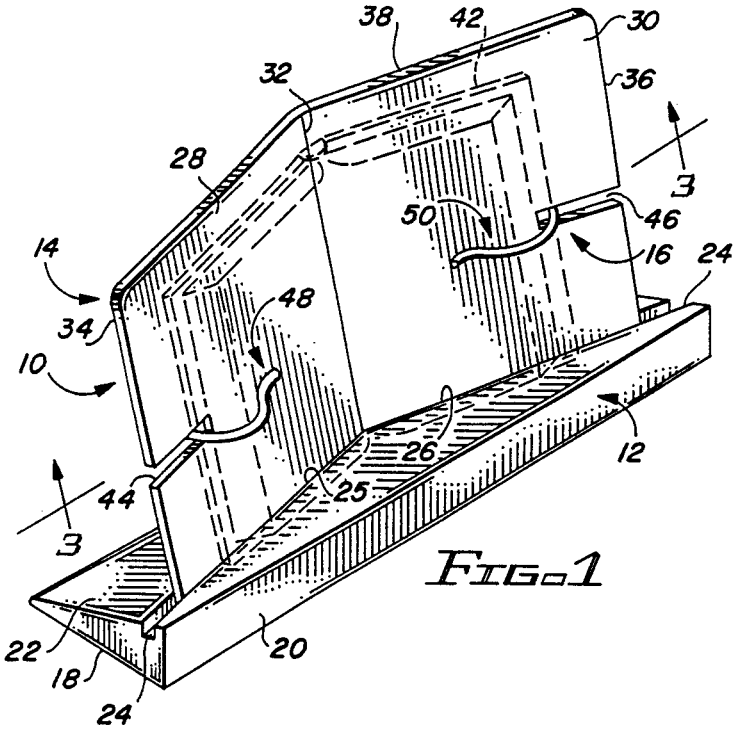
FIG. 1 is a perspective view of the book rest with the page retainer means of the present invention showing the various features thereof.

Referring more particularly to the drawings, FIG. 1 shows the book rest structure of the present invention which is indicated in its entirety by the reference numeral 10. The book rest 10 includes the basic elements of a base 12, a prop structure 14 and a page retaining means 16, as will hereinafter be described in detail.

The base 12 is elongated and has a transverse shape in the preferred form of a right triangle to provide first and second surfaces 18 and 20 which are at right angles with respect to each other and a third surface 22 which is the hypotenuse of the triangle. For reasons which will become apparent as this description progresses, the first surface 18 is the bottom of the base, the second surface 20 is the front of the base and the third surface 22 is the top, or upper surface thereof.

An upwardly opening groove 24 is formed in the upper surface 22 of the base so as to extend between the opposite ends thereof although its actually opening onto the opposite ends is not necessary. The groove 24 is formed of a pair of legs 25 and 26 which extend oppositely from a central point which is the vertex of an included angle of less than 180° defined by the two legs, as will hereinafter be described.

Figure 2:
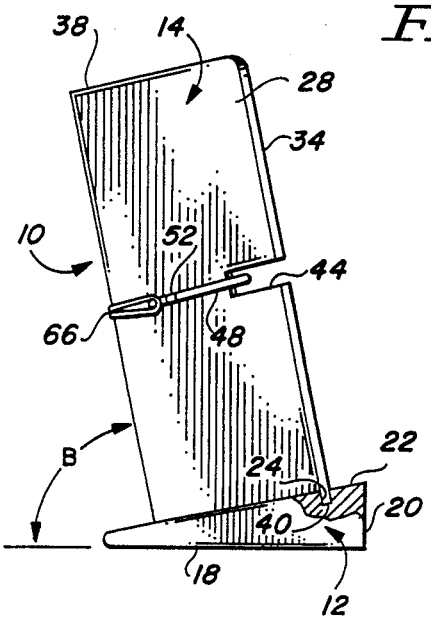
FIG. 2 is a side elevational view of the book rest.

The prop structure 14 is bisected by a transverse center line 32 to provide a pair of juxtaposed planar walls 28 and 30 which are integral and extend oppositely from the center line which is a linear vertex of an included angle of less than 180° defined by the angular relationship of the planar walls 28 and 30. The included angle of the prop structure 14 is the same as the included angle of groove 24. The prop 14 has an opposed pair of side edges 34 and 36, a top edge 38 and a bottom edge 40. The bottom edge 40 of the prop structure 14 is mounted in the groove 24 so that the prop structure extends substantially normally and upwardly from the upper surface 22 of the base 12. Since the upper surface 22 slopes downwardly and away from the front surface 20 of the base the prop structure is disposed to lie in a leaning attitude which forms an acute included angle B with respect to the horizontal as indicated in FIG. 2 Angle B is not critical and may deviate from a suggested and preferred angle of about 70° in the range from about 65° to about 85°.

Figure 3:
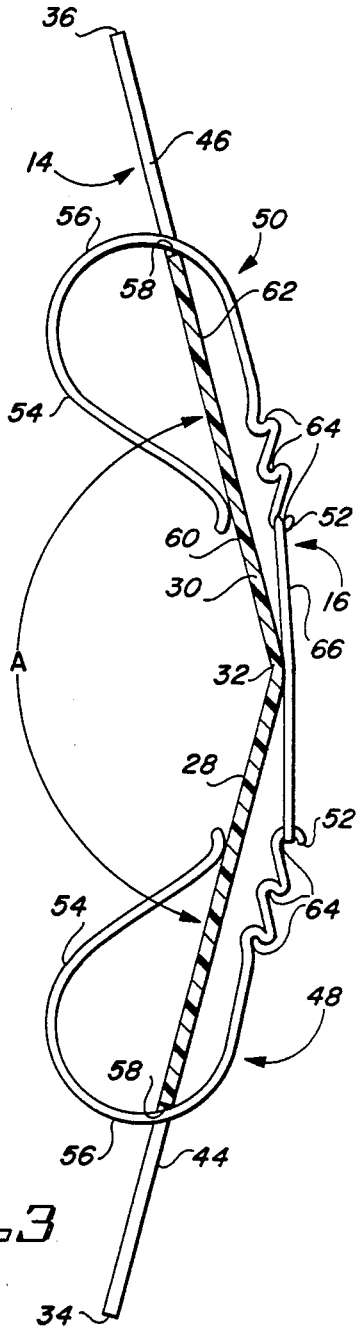
FIG. 3 is an enlarged sectional view taken along the line 3—3 of FIG. 1 and showing a first embodiment of the page retainer means.

The included obtuse angle between the juxtaposed walls 28 and 30 of the prop structure 14, identified as angle A in FIG. 3, also is not particularly critical and may also vary from the preferred suggested angle of about 150° in the range of from about 120° to about 160°.

As a result of the leaning back attitude of the prop structure 14, the right angle relationship of the prop 14 with respect to the top surface of the base 12 and the included angle A defined by the prop structure, the book rest 10 is ideally configured for supporting a book or magazine as indicated in FIG. 1 by the dashed line showing of a book 42.

The prop structure 14 is provided with a pair of slots 44 and 46 with the slot 44 being formed to extend inwardly from the side edge 34 of the prop wall 28 and the slot 46 being similarly formed so as to extend inwardly from side edge 36 of the prop wall 30. The slots 44 and 46 are provided to accommodate the page retaining means 16 as disclosed below.

The first embodiment of the page retaining means 16 is seen best in FIG. 3 to include a special pair of hook-like devices 48 and 50. The hooks 48 and 50 are identical with each having what may be defined as a connection end 52, a page engaging end 54, and an intermediate substantially semi-circular bight portion 56. The hooks 48 and 50 are disposed in the slots 44 and 46 respectively so that their bight portions 56 are looped through the slots and are normally in engagement with the end surfaces 58 of the slots for reasons which will become apparent as this description progresses. The hooks are placed in the slots so that the page engaging ends 54 extend from the slots toward the center line 32 on the front side 60 of the prop structure 14 and the connection ends 52 of the hook extend similarly from the slot toward the center line 32 on the back side 62 thereof.

The connection ends 52 of the hooks 48 and 50 are each provided with a linearly arranged plurality of curved notches 64 which provide means for adjustable connection of an elastic band 66 between the connection ends 52 of the two hooks. Thus, the hooks 48 and 50 are biased toward each other and this brings the bight portions 56 of the hooks in normal engagement with the bottom end surfaces 58 of the slots 48 and 50 as disclosed above.

As is known, books have different sizes, and when the cover flaps of a book are relatively wide, the side edges of the flaps will push and hold the hooks 48 and 50 away from the bottom surfaces 58 of their respective slots 44 and 46 against the bias of the elastic band 66. The band itself may be selected to provide a predetermined tension and can be connected to selected ones of the notches 64 of the hooks for tension adjusting purposes.

The hooks 48 and 50 may be formed of any suitable material such as wire which is capable of being formed into the desired shape and should have enough memory to retain its basic shape. In otherwords, the material of which the hooks are formed need not have a high degree of resiliency and may be somewhat deformable. In this embodiment, the page engaging ends 54 of the hooks are biased into a page holding position by the elastic band 66.

Figure 4:
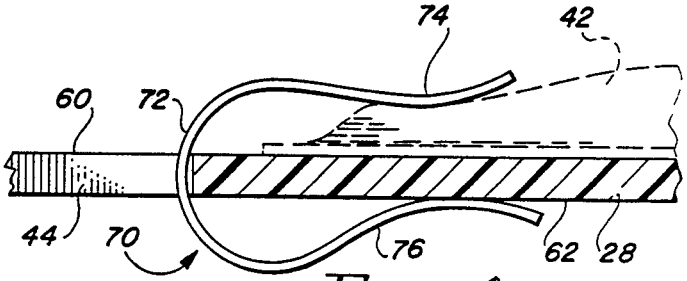
FIG. 4 is a fragmentary sectional view similar to FIG. 3 and showing a second embodiment of the page retainer means.

The second embodiment of the page retaining means as shown, in FIG. 4 includes an identical pair of spring clips 70 (one shown) each of which is demountably carried in one of the slots 44 and 46. The spring clips 70 are of U-shaped configuration with a arcuate bight portion 72 and a page engaging arm 74 and a prop structure engaging arm 76. The spring clips 68 are looped through their respective slots so that the arms extend inwardly toward the center line 32 of the prop structure 14. In the absence of a book or magazine, the page engaging arm 74 will be in bearing engagement with the front side 60 of the prop 14 and the other arm 76 will be in bearing engagement with the back side 62 of the prop. When a book is being propped up in the book rest 10, one of the cover flaps and some of the pages of the book, as indicated at 42 in FIG. 4, will be interposed between the page engaging arm 74 of the spring clip and the front 60 of the prop. The spring clips 70 may be formed of any suitable resilient material such as metal, plastic and the like.

Figure 5:
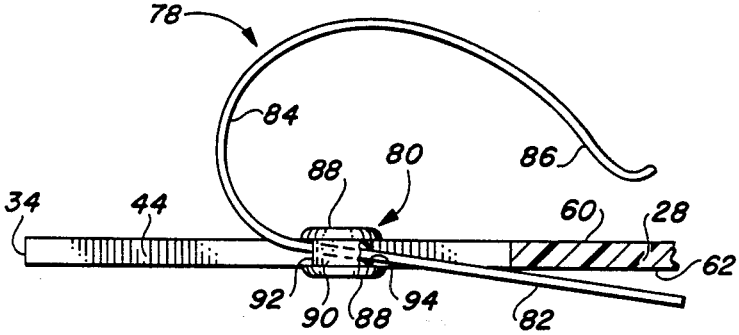
FIG. 5 is a fragmentary sectional view similar to FIG. 3 and showing a third embodiment of the page retainer means.

The third embodiment of the page retaining means as shown in FIG. 5 includes a pair of identical hooks 78 (one shown), each of which is provided with a carrier means 80 by which the hooks are adjustably mounted in their respective slots 44 and 46. In that the hooks 78 and carrier means 80 are identical, the following description of the hook 78 and carrier means 80 illustrated in FIG. 5 will be understood to be typical.

The hook 78 has a linear end which forms a shank 82, an arcuately curved bight portion 84 and a page engaging end 86. The hook 78 is formed of a spring-like resilient material such as piano wire for reasons which will hereinafter be described.

The carrier means 80 is preferably of generally cylindrical configuration and is formed of a resiliently deformably elastomeric material such as rubber, Neoprine or the like. The carrier means 80 has a pair of flanges 88 with each flange being located on a different one of the opposite ends of a reduced diameter cylindrical body 90, with the flanges and body cooperatively defining an annular groove 92. The diameter of the cylindrical body 90 is slightly greater than the width dimension of the slot 44 of the prop structure 14 in which it is mounted. In this manner, the carrier means 80 provides an interference fit with its slot 44 and is held against sliding movement but can be slidably moved by a manually exerted force.

The carrier means 80 is further provided with a hole 94 that is drilled, punched or otherwise formed substantially transversely through the cylindrical body 90 thereof, and the linear shank 82 of the hook 78 extends through the hole. The carrier means 80 is mounted in the slot 44 so that the shank 82 of the hook 78 is proximate the back side 62 of the prop structure 14 and the page engaging end 86 is proximate the front side 60, the inherent resiliency of the hook 78 will provide the page holding capability in hooks and magazines of different thicknesses. The slidable movement of the carrier means 80, and thus the hook 78, in the slot 44 allows variously sized books and magazines to be held on the book rest 10. This latter adjustment is enhanced by virtue of the shank 82 being slidably relocatable in the hole 94 of the carrier means 80. It will also be noted that the bight portion 83 and the page engaging end 86 of the hook can be moved out of the way if page holding capability is not needed by simply rotating the hook about the longitudinal axis of the shank 82 until the bight portion and page engaging end are in back of the prop structure.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

What I claim is:

1. A book rest for supporting books and magazines comprising:

(a) a base for resting placement on a substantially horizontal surface, said base having a front and having an upper surface;

(b) a prop structure extending from the upper surface of said base in a leaning attitude away from the front of said base, said prop structure including a pair of juxtaposed planar walls which extend oppositely from a central linear vertex and defines an included obtuse angle which opens toward the front of said base, said prop structure defining a front side which faces the front of said base and having an opposite back side;

(c) said prop structure defining a pair of slots each formed so as to extend inwardly from the distal edge of a different one of said pair of juxtaposed planar walls toward the central vertex thereof; and (d) page retainer means mounted in the slots defined by said prop structure for releasably holding the pages of a book in an open position against the front side of said prop structure, said page retainer means comprising, I. a pair of hooks each positioned in a different one of said pair of slots defined by said prop structure, each of said pair of hooks including, i. a curved bight portion looped through its respective one of said pair of slots of said prop structure, ii. a page engaging end extending integrally from one end of said bight portion toward the central vertex along the front side of said prop structure, iii. a connection end extending integrally from the other end of said bight portion toward the central vertex along the back side of said prop structure said connection end being provided with at least one curved notch, II. biasing means interconnecting said connection ends of said pair of hooks said biasing means is in the form of an elastic band connected between the curved notches of said pair of hooks.

2. A book rest as claimed in claim 1 wherein said prop structure leans away from the front of said base and forms an acute angle with respect to the horizontal in the range of about from 65° to 85°.

3. A book rest as claimed in claim 1 wherein said prop structure leans away from the front of said base and forms an acute angle with respect to the horizontal of approximately 70°.

4. A book rest as claimed in claim 1 wherein the included angle defined by the pair of juxtaposed planar walls of said prop structure is in the range of from about 120° to 160°.

5. A book rest as claimed in claim 1 wherein said prop structure extends normally from the upper surface of said base and the upper surface of said base slopes angularly an downwardly from the front of said base to provide the leaning attitude of said prop structure.

6. A book rest as claimed in claim 1 wherein the included angle defined by the pair of juxtaposed planar walls of said prop structure is approximately 150°.

7. A book rest for supporting books and magazines comprising:

(a) a base for resting placement on a substantially horizontal surface, said base having a front and having an upper surface;

(b) a prop structure extending from the upper surface of said base in a leaning attitude away from the front of said base, said prop structure including a pair of juxtaposed planar walls which extend oppositely from a central linear vertex and defines an included obtuse angle which opens toward the front of said base, said prop structure defining a front side which faces the front of said base and having an opposite back side;

(c) said prop structure defining a pair of slots each formed so as to extend inwardly from the distal edge of a different one of said pair of juxtaposed planar walls toward the central vertex thereof; and (d) page retainer means mounted in the slots defined by said prop structure for releasably holding the pages of a hook in an open position against the front side of said prop structure, said page retainer means comprises, I. a pair of hooks each positioned in a different one of said pair of slots defined by said prop structure, each of said pair of hooks including an arcuate bight portion, a page engaging end extending integrally from one end of said bight portion and a linear shank extending integrally from the other end of said bight portion, II. a pair of carrier means each slidably movable in a different one of said pair of slot, each of said pair of carrier means being in carrying engagement with the linear shank of one of said pair of hooks for positioning the page engaging end of that one of said pair of hooks proximate the front side of said prop structure and the linear shank proximate the bank side thereof.

8. A book rest as claimed in claim 7 wherein each of said pair of hooks is formed of a spring-like resilient material.

9. A book rest as claimed in claim 7 wherein each of said pair of carrier means comprises an elastomeric body slidably mounted in one of said pair of slots of said prop structure and being sized to provide an interference fit therein, said body having a hole formed substantially transversely therethrough with the linear shank of one of said pair of hook extending through the hole of said body.

10. A book rest as claimed in claim 7 wherein each of said pair of carrier means comprises a pair of flanges each located at a different one of the opposite ends of a reduced diameter cylindrical body, said flanges and said body being formed of an elastomeric material with said body having a diameter which is slightly greater than the width dimension of the one of said pair of slots of said prop structure to provide an interference fit between said body and said slot, said body having a hole formed substantially diametrically therethrough with the linear shank of its respective one of said pair of hook extending through the hole of said body.

11. A book rest for supporting books and magazines in an opened position comprising:

(a) a base for resting placement on an substantially horizontal surface, said base having a front and an upper surface;

(b) a prop extending from the upper surface of said base in an attitude which leans backwardly from the front of said base, said prop having a front side which faces the front of said base and an opposed back side, said prop being bisected by a transverse center line to provide a pair of juxtaposed integral planar walls which extend oppositely from the center line to define an included obtuse angle which opens toward the front of said base, each of said pair of planar walls having a distal side edge;

(c) each of said pair of juxtaposed planar walls of said prop having a slot formed in its distal side edge which extends toward the center line of said prop; and (d) page retaining means in the slots defined by said prop for releasably holding the pages of a book in an opened position against the front side of said prop, said page retaining means including, I. a pair of hooks each positioned in a different one of said pair of slots defined by said prop, each of said pair of hooks having a curved bight portion looped through its respective one of said pair of slots of said prop, a page engaging end extending integrally from one end of said bight portion toward the center line along the front side of said prop, and a connection end extending integrally from the other end of said bight portion toward the center line along the back side of said prop, said connection end of each of said pair of hooks having at least one curved notch formed therein, II. biasing means in the form of an elastic band connection between the curved notches formed in said connection ends of said pair of hooks.

12. A book rest for supporting books and magazines in an opened position comprising:

(a) a base for resting placement on a substantially horizontal surface, said base having a front and an upper surface;

(b) a prop extending from the upper surface of said base in an attitude which leans backwardly from the front of said base, said prop having a front side which faces the front of said base and an opposed back side, said prop being bisected by a transverse center line to provide a pair of juxtaposed integral planar walls which extend oppositely from the center line to define an included obtuse angle which opens toward the front of said base, each of said pair of planar walls having a distal side edge;

(c) each of said pair of juxtaposed planar walls of said prop having a slot formed in its distal side edge which extends toward the center line of said prop; and (d) page retaining means in the slots defined by said prop for releasably holding the pages of a book in an opened position against the front side of said prop, said page retaining means includes, I. a pair of hooks formed of spring-like resilient material each positioned in a different one of said pair of slots defined by said prop, each of said pair of hooks including an arcuate bight portion, a pair engaging end extending integrally from one end of said bight portion and a linear shank extending integrally from the other end of said bight portion, II. a pair of carrier means each slidably movable in a different one of said pair of slots, each of said pair of carrier means being in carrying engagement with the linear shank of one of said pair of hooks for positioning the page engaging end of that one of said pair of hooks proximate the front side of said prop and the linear shank proximate the back side thereof.

13. A book rest as claimed in claim 12 wherein each of said pair of carrier means comprises a pair of flanges each located at a different one of the opposite ends of a reduced diameter cylindrical body, said flanges and said body being formed of an elastomeric material with said body having a diameter which is slightly greater than the width dimension of the one of said pair of slots of said prop to provide an interference fit between said body and said slot, said body having a hole formed substantially diametrically therethrough with the linear shank of its respective one of said pair of hooks extending through the hole of said body.

* * * * *